US009646534B2

(12) United States Patent
Yoo et al.

(10) Patent No.: US 9,646,534 B2
(45) Date of Patent: May 9, 2017

(54) ORGANIC LIGHT-EMITTING DISPLAY APPARATUS AND METHOD OF DRIVING THE SAME

(71) Applicant: SAMSUNG DISPLAY CO., LTD., Yongin, Gyeonggi-Do (KR)

(72) Inventors: Youngwook Yoo, Yongin (KR); Naoaki Komiya, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 3 days.

(21) Appl. No.: 14/708,071

(22) Filed: May 8, 2015

(65) Prior Publication Data

US 2016/0148572 A1 May 26, 2016

(30) Foreign Application Priority Data

Nov. 24, 2014 (KR) ..... 10-2014-0164425

(51) Int. Cl.
*G09G 3/32* (2016.01)
*G09G 3/3233* (2016.01)

(52) U.S. Cl.
CPC ... *G09G 3/3233* (2013.01); *G09G 2300/0819* (2013.01); *G09G 2300/0852* (2013.01); *G09G 2300/0861* (2013.01); *G09G 2320/029* (2013.01); *G09G 2320/0223* (2013.01); *G09G 2320/045* (2013.01)

(58) Field of Classification Search
CPC ..... G09G 5/003; G09G 5/02; G09G 5/10
See application file for complete search history.

(56) References Cited

U.S. PATENT DOCUMENTS

| | | | | |
|---|---|---|---|---|
| 2002/0050962 | A1 | 5/2002 | Kasai | |
| 2004/0095338 | A1 | 5/2004 | Miyazawa | |
| 2005/0099412 | A1 | 5/2005 | Kasai | |
| 2009/0051628 | A1* | 2/2009 | Kwon | G09G 3/3233 345/77 |
| 2009/0184901 | A1* | 7/2009 | Kwon | G09G 3/3233 345/77 |
| 2014/0062843 | A1* | 3/2014 | Yang | G09G 3/3233 345/76 |
| 2015/0029171 | A1 | 1/2015 | Jo | |
| 2015/0130866 | A1 | 5/2015 | Bae et al. | |

FOREIGN PATENT DOCUMENTS

| | | | |
|---|---|---|---|
| KR | 2002-0029317 | A | 4/2002 |
| KR | 10-2004-0019915 | A | 3/2004 |
| KR | 10-2005-0045814 | A | 5/2005 |
| KR | 10-2015-0012022 | A | 2/2015 |
| KR | 10-2015-0054124 | | 5/2015 |

* cited by examiner

*Primary Examiner* — Olga Merkoulova
(74) *Attorney, Agent, or Firm* — Lewis Roca Rothgerber Christie LLP

(57) ABSTRACT

An organic light-emitting display apparatus including at least one pixel including an OLED, a first transistor connected to a connection line, a second transistor connected to a power line, and to the first transistor, a third transistor connected to a data line, a fourth transistor connected to the third transistor, and to the first transistor, a fifth connected to the fourth transistor, a sixth transistor connected to the fifth transistor, and to the fifth transistor, a seventh transistor connected to the fifth transistor, and to the OLED, and first and second capacitors connected between electrodes of the fourth and fifth transistors, respectively.

20 Claims, 9 Drawing Sheets

ORGANIC LIGHT-EMITTING DISPLAY APPARATUS AND METHOD OF DRIVING THE SAME

CROSS-REFERENCE TO RELATED APPLICATION

This application claims priority to and the benefit of Korean Patent Application No. 10-2014-0164425, filed on Nov. 24, 2014, in the Korean Intellectual Property Office, the disclosure of which is incorporated herein in its entirety by reference.

BACKGROUND

1. Field

One or more embodiments relate to an organic light-emitting display apparatus and a method of driving the organic light-emitting display apparatus.

2. Description of the Related Art

An organic light-emitting display apparatus displays an image by using an organic light-emitting diode (OLED). Such an organic light-emitting display apparatus provides a fast response and is driven with low power consumption. The organic light-emitting display apparatus may not be able to display an image having a desired brightness due to an efficiency variation caused by degradation of the OLED.

SUMMARY

Aspects of one or more exemplary embodiments include an organic light-emitting display apparatus capable of sensing degradation of an organic light emitting diode (OLED) and, accordingly, capable of accurately correcting image data, and a method of driving the organic light-emitting display apparatus.

Additional aspects will be set forth in part in the description which follows and, in part, will be apparent from the description, or may be learned by practice of the presented embodiments.

According to one or more embodiments of the present invention, there is provide an organic light-emitting display apparatus including at least one pixel, the at least one pixel including: an organic light emitting diode (OLED); a first transistor including a gate electrode, a first electrode connected to a connection line for providing a current, and a second electrode; a second transistor including a gate electrode, a first electrode connected to a power line, and a second electrode connected to the second electrode of the first transistor; a third transistor including a gate electrode, a first electrode connected to a data line, and a second electrode; a fourth transistor including a gate electrode connected to the second electrode of the third transistor, a first electrode connected to the second electrode of the first transistor, and a second electrode; a fifth transistor including a gate electrode, a first electrode connected to the second electrode of the fourth transistor, and a second electrode; a sixth transistor including a gate electrode, a first electrode connected to the gate electrode of the fifth transistor, and a second electrode connected to the second electrode of the fifth transistor; a seventh transistor including a gate electrode, a first electrode connected to the second electrode of the fifth transistor, and a second electrode connected to the OLED; a first capacitor connected between the gate electrode and the first electrode of the fourth transistor; and a second capacitor connected between the gate electrode and the first electrode of the fifth transistor.

In an embodiment, during a first period, the fourth transistor is turned on by a gate-on voltage supplied via the data line when the third transistor is turned on, and a first current is supplied from the connection line when the first transistor is turned on, and the fifth transistor is diode-connected when the sixth transistor is turned on, and thus a voltage corresponding to the first current is stored in the second capacitor.

In an embodiment, the first period is allocated before one frame starts or in an initial part of one frame.

In an embodiment, the first current has a current value corresponding to a maximum gray level expressed by the pixel.

In an embodiment, during a first period of each of a plurality of sub-frames constituting one frame, the second transistor and the third transistor are turned on to store a voltage corresponding to a data signal applied from the data line in the first capacitor.

In an embodiment, during a second period subsequent to the first period of each of the sub-frames, the second transistor is turned on, the third transistor is turned off, and the fourth transistor is turned on or off according to a voltage stored in the first capacitor, when the fourth transistor is turned off, the OLED does not emit light, and when the fourth transistor is turned on, the OLED emits light having a brightness corresponding to the voltage stored in the second capacitor.

In an embodiment, the at least one pixel further includes an eighth transistor including a gate electrode, a first electrode connected to the second electrode of the second transistor, and a second electrode connected to the OLED.

In an embodiment, during a third period, the second, third, fourth, fifth, sixth, and seventh transistors are turned off, the first transistor and the eighth transistor are turned on, and a second current supplied from the connection line is applied to the OLED.

In an embodiment, the third period is allocated when the organic light-emitting display apparatus is powered on and/or off.

In an embodiment, the organic light-emitting display apparatus further includes: a sensing unit configured to supply a first current to the connection line during a first period to write the first current to the pixel and to supply a second current to the connection line during a second period to sense a degradation of the OLED; a controller configured to generate corrected data by compensating for the sensed degradation of the OLED; and a data driver configured to supply additional data to the data line during the first period and to supply corrected data to the data line during a third period.

In an embodiment, the additional data includes a signal having a first level to turn on the fourth transistor, and the corrected data includes a signal having a second level to turn off the fourth transistor or the first level.

In an embodiment, a method of driving the organic light-emitting display apparatus includes: supplying a first current to the pixel to write a first current to the pixel; supplying a data signal to the pixel to write a data signal to the pixel; and emitting light having a brightness corresponding to the first current or emitting no light, according to the data signal, wherein the emitting of light or the emitting of no light is performed in the pixel.

In an embodiment, in the writing of the first current, the fourth transistor is turned on by a gate-on voltage supplied via the data line when the third transistor is turned on, and the first current is supplied via the connection line when the first transistor is turned on, and the fifth transistor is diode-connected when the sixth transistor is turned on, and thus a voltage corresponding to the first current is stored in the second capacitor.

In an embodiment, the writing of the first current is performed before one frame starts or in an initial part of one frame.

In an embodiment, the first current has a current value corresponding to a maximum gray level expressed by the pixel.

In an embodiment, in the writing of the data signal, during a first period of each of a plurality of sub-frames constituting one frame, the second transistor and the third transistor are turned on to store a voltage corresponding to a data signal applied from the data line in the first capacitor.

In an embodiment, in the emitting of light or the emitting of no light in the pixel, during a second period subsequent to the first period of each of the sub-frames, the second transistor is turned on, the third transistor is turned off, and the fourth transistor is turned on or off according to a voltage stored in the first capacitor, and when the fourth transistor is turned off, the OLED emits no light, and, when the fourth transistor is turned on, the OLED emits light having a brightness corresponding to the voltage stored in the second capacitor.

In an embodiment, the pixel further includes an eighth transistor including a gate electrode, a first electrode connected to the second electrode of the second transistor, and a second electrode connected to the OLED.

In an embodiment, the method further includes applying a second current supplied from the connection line to the OLED when the second to seventh transistors are turned off and the first transistor and the eighth transistor are turned on; and sensing degradation of the OLED based on the second current.

In an embodiment, the sensing of the degradation is performed when the organic light-emitting display apparatus is powered on and/or off.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
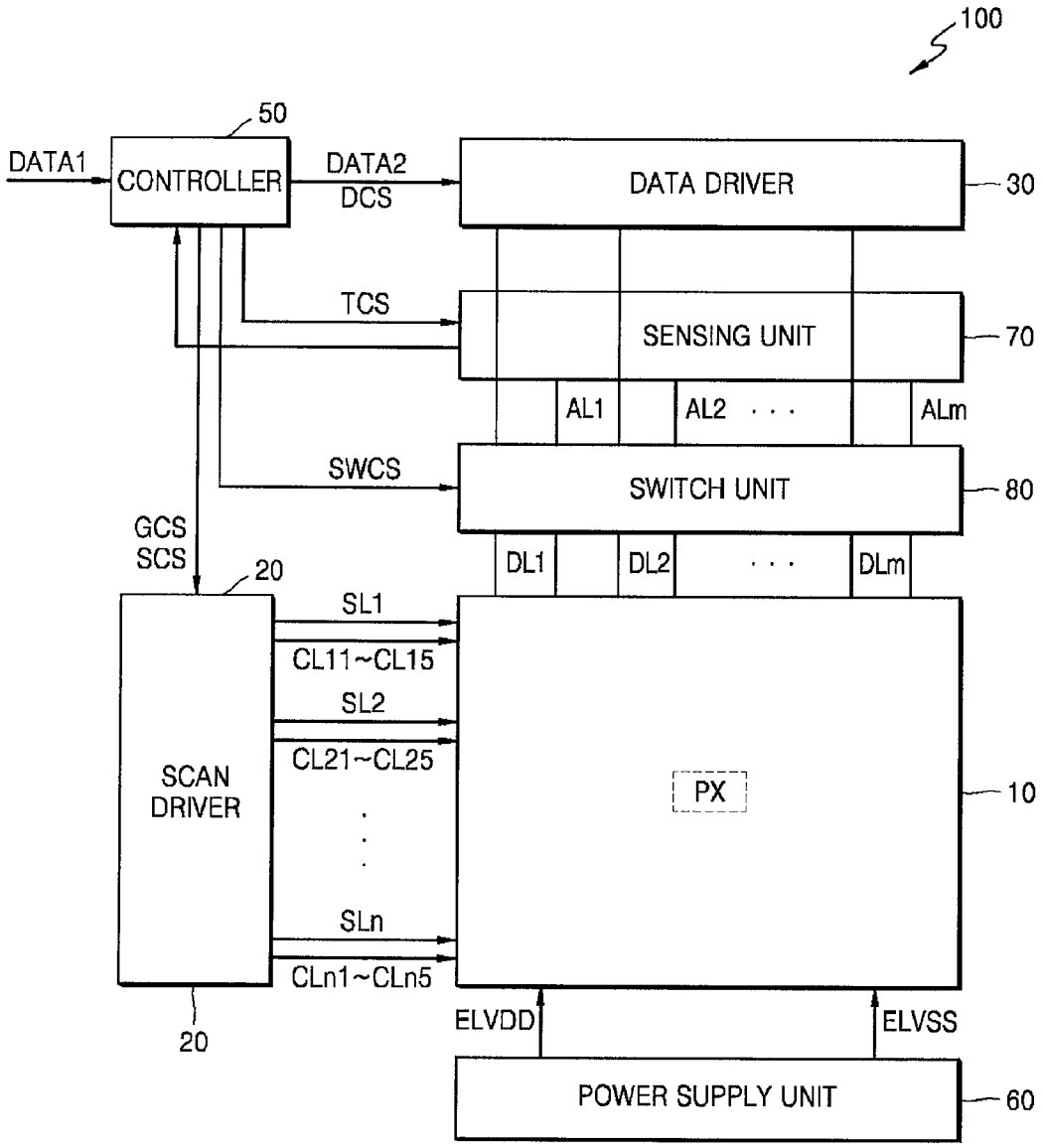
FIG. 1 is a block diagram of a display apparatus according to an embodiment of the present invention.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent to" another element or layer, it can be directly on, connected to, coupled to, or adjacent to the other element or layer, or one or more intervening elements or layers may be present. When an element or layer is referred to as being "directly on," "directly connected to", "directly coupled to", or "immediately adjacent to" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

The organic light-emitting display apparatus and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the organic light-emitting display apparatus may be formed on one integrated circuit (IC) chip or on separate IC chips. Further, the various components of the organic light-emitting display apparatus may be implemented on a flexible printed circuit film, a tape carrier package (TCP), a printed circuit board (PCB), or formed on a same substrate as the organic light-emitting display apparatus. Further, the various components of the organic light-emitting display apparatus may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

FIG. 1 is a block diagram of a display apparatus 100 according to an embodiment of the present invention.

Referring to FIG. 1, the display apparatus 100 includes a display unit 10, a scan driver 20, a data driver 30, a controller 50, a power supply unit (or power supply) 60, a sensing unit (or sensor) 70, and a switch unit (or switch) 80. The display apparatus 100 may be an organic light-emitting display apparatus.

The display unit 10 includes a plurality of pixels PX arranged in a matrix. Each pixel PX is connected to a scan line SL, a data line DL, a plurality of control lines CL, and a power line which applies a first power supply voltage ELVDD.

The display unit 10 includes scan lines SL1-SLn and control lines CL1-CLn connected to the scan driver 20, data lines DL1-DLm connected to the data driver 30, and connection lines AL1-ALm connected to the sensing unit 70. The display unit 10 further includes a power line network for applying the first power supply voltage ELVDD and/or the second power supply voltage ELVSS to the pixels PX. Each of the scan lines SL1-SLn and each of the control lines CL11-CLn5 are connected to pixels PX arranged on a same row, and each of the data lines DL1-DLm and each of the connection lines AL1-ALm are connected to pixels PX arranged on a same column. The pixels PX emit light or emit no light according to the logic levels of data signals that are received via the data lines DL1-DLm, in response to scan signals received via the scan lines SL1-SLn. In this case, the display unit 10 operates in a digital driving manner.

The scan driver 20 drives the scan lines SL1-SLn according to an order (e.g., a preset or predetermined order) within one frame, under the control of the controller 50. For example, the first scan line SL1 is driven by the scan driver 20 a plurality of number of times within one frame. In other words, the scan driver 20 outputs a scan signal to the first scan line SL1 a plurality of number of times during one frame. One frame includes a plurality of sub-frames, and the scan driver 20 outputs as many scan signals as the number of sub-frames to the first scan line SL1 during one frame.

The scan driver 20 drives the control lines CL11-CLn5 under the control of the controller 50. Although one control line is illustrated for one pixel row in FIG. 1, this is for convenience of illustration, and thus each control line shown may represent five control lines. For example, a control line on an n-th pixel row may include first to fifth control lines CLn1-CLn5.

The data driver 30 receives corrected data DATA2 from the controller 50 and applies the corrected data DATA2 as a data signal to the pixel PX via the data lines DL1-DLm. The data signal is a digital signal having a low level or a high level, and the pixel PX having received the data signal for each sub-frame emits light or emits no light according to the logic level of the data signal.

It is assumed herein that the pixel PX having received a data signal having a first logic level emits light and the pixel PX having received a data signal having a second logic level emits no light. According to a circuit structure of the pixel PX, the first logic level may be a low level and the second logic level may be a high level, or the first logic level may be a high level and the second logic level may be a low level.

The data driver 30 may apply an additional signal having the first logic level to the pixel PX via the data lines DL1-DLm during an allocated time period, before a frame starts or in an initial part of a frame.

The power supply unit 60 receives external power and/or internal power, converts the received external power and/or internal power into voltages of various suitable levels that are used for operations of the components of the display apparatus 100, and supplies a suitable voltage to the display unit 10. The power supply unit 60 may be mounted on a printed circuit board (PCB) and may be electrically connected to the display unit 10 via a flexible PCB.

The power supply unit 60 may generate the first power supply voltage ELVDD and the second power supply voltage ELVSS under the control of the controller 50. The power supply unit 60 provides the first power supply voltage ELVDD and the second power supply voltage ELVSS to the display unit 10. A voltage level of the first power supply voltage ELVDD is higher than that of the second power supply voltage ELVSS. For example, when the first power supply voltage ELVDD is applied to an anode of an organic light emitting diode (OLED) and the second power supply voltage ELVSS is applied to a cathode thereof, the OLED emits light.

The sensing unit 70 extracts information about the degree of degradation of a light emitting device, namely, an OLED, included in each of the pixels PX. The time when the sensing unit 70 extracts the information about the degradation of the pixels PX is not limited to a particular time. For example, the sensing unit 70 may extract the information about the degradation of the pixels PX every time the display apparatus 100 is powered on and/or off. The sensing unit 70 may apply a sensing current to the pixel PX and sense a current that flows in the OLED of the pixel PX. The sensing unit 70 may be connected to the connection line AL and to the pixels PX via the switch unit 80.

The sensing unit 70 may apply a programming current to each of the pixels PX during an allocated period (e.g., an allocated preset or predetermined time period) before or after a frame starts. The programming current may reduce (e.g., minimize) a voltage drop of a power line that applies the first power supply voltage ELVDD when the pixel PX emits light. As for the 8-bit image data, the programming current may be a current corresponding to a gray level of 255, which is a maximum gray level from among gray levels of 1 to 255.

The switch unit 80 may connect the data driver 30 to the data lines DL1-DLm or connect the sensing unit 70 to the connection lines AL1-ALm.

The controller 50 controls the scan driver 20, the data driver 30, the sensing unit 70, and the switch unit 80. The controller 50 generates and outputs a plurality of driving control signals.

The controller 50 may generate a scan driving control signal SCS and a gate control signal GCS and transmit the scan driving control signal SCS and the gate control signal GCS to the scan driver 20. The scan driving control signal SCS may control the scan driver 20 to provide the scan signal to each of the scan lines SL1-SLn. The gate control signal GCS may control the scan driver 20 to provide a control signal to each of the control lines CL11-CLn5.

The controller 50 may generate a data driving control signal DCS and transmit the data driving control signal DCS to the data driver 30. The data driving control signal DCS may control the data driver 30 to provide, as in the data signal, corresponding corrected data DATA2 to each of the data lines DL1-DLm.

The controller 50 may generate a sensing control signal TCS and transmit the sensing control signal TCS to the sensing unit 70. The sensing control signal TCS may control the sensing unit 70 to output the programming current or the sensing current and sense a current that flows in the OLED.

The controller 50 may generate a switching control signal SWCS and transmit the switching control signal SWCS to the switch unit 80. The switching control signal SWCS may control at least one switch constituting the switch unit 80 to be turned on or off so that the data driver 30 is connected to the data lines DL1-DLm or the sensing unit 70 is connected to the connection lines AL1-ALm.

The controller 50 receives image data DATA1 from an external source, generates corrected data DATA2 by compensating for the degradation of the OLED that is sensed by the sensing unit 70 from the image data DATA1, and outputs the corrected data DATA2 to the data driver 30.

Figure 2:
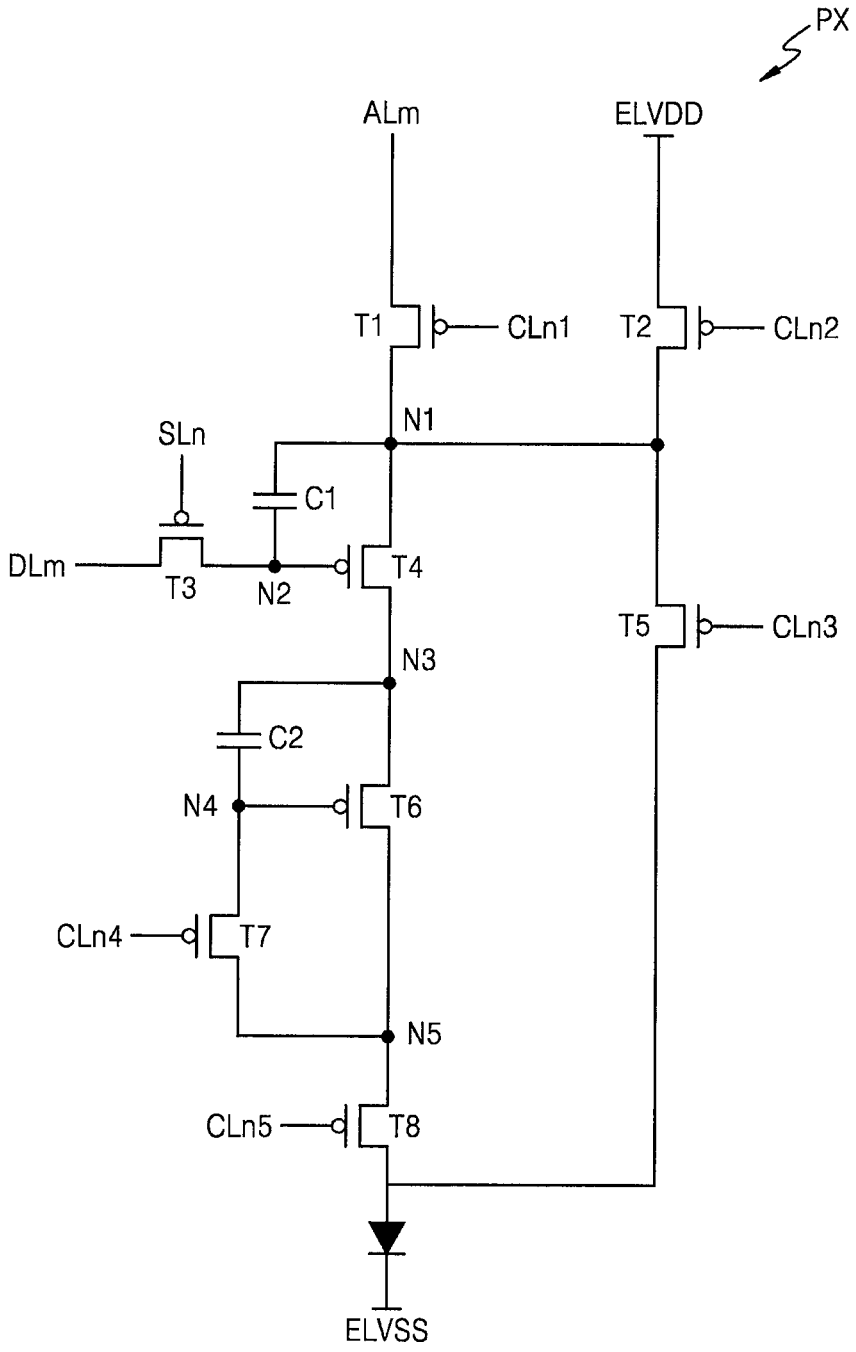
FIG. 2 is a circuit diagram illustrating a circuit structure of a pixel of the display apparatus of FIG. 1.

FIG. 2 is a circuit diagram illustrating a circuit structure of a pixel PX of the display apparatus 100 of FIG. 1.

For convenience of explanation, FIG. 2 illustrates a pixel PX at a location corresponding to an n-th pixel row and an m-th pixel column in the display unit 10. The pixel PX is connected to an n-th scan line SLn, first to fifth control lines CLn1-CLn5 on the n-th pixel row, an m-th data line DLm, and an m-th connection line ALm. The pixel PX receives an additional signal or a data signal via the data line DLm. The pixel PX receives a programming current or a sensing current via the connection line ALm.

The pixel PX includes first to eighth transistors T1-T8, first and second capacitors C1 and C2, and an OLED. The pixel PX includes a first node N1 to which the first transistor T1, the second transistor T2, and the fourth transistor T4 are connected, a second node N2 to which a gate electrode of the fourth transistor T4 is connected, a third node N3 to which the fourth transistor T4 and the sixth transistor T6 are connected, a fourth node N4 to which a gate electrode of the sixth transistor T6 is connected, and a fifth node N5 to which the sixth transistor T6 and the eighth transistor T8 are connected.

The first transistor T1 includes a gate electrode connected to the first control line CLn1, a first electrode connected to the connection line ALm, and a second electrode connected to the first node N1. The first transistor T1 controls the programming current or the sensing current to be applied to the pixel PX via the connection line ALm.

The second transistor T2 includes a gate electrode connected to the second control line CLn2, a first electrode connected to a power line that provides the first power supply voltage ELVDD, and a second electrode connected to the first node N1.

The third transistor T3 includes a gate electrode connected to the scan line SLn, a first electrode connected to the data line DLm, and a second electrode connected to the second node N2.

The fourth transistor T4 includes the gate electrode connected to the second node N2, a first electrode connected to the first node N1, and a second electrode connected to the third node N3. The fourth transistor T4 is turned on or off according to a voltage applied to the gate electrode.

The fifth transistor T5 includes a gate electrode connected to the third control line CLn3, a first electrode connected to the first node N1, and a second electrode connected to an anode of the OLED. The fifth transistor T5 transmits the sensing current.

The sixth transistor T6 includes the gate electrode connected to the fourth node N4, a first electrode connected to the third node N3, and a second electrode connected to the fifth node N5. The sixth transistor T6 is a driving transistor. The programming current applied via the first transistor T1 may compensate for a threshold voltage of the sixth transistor T6.

The seventh transistor T7 includes a gate electrode connected to the fourth control line CLn4, a first electrode connected to the fourth node N4, and a second electrode connected to the fifth node N5.

The sixth transistor T6 and the seventh transistor T7 are transistors for writing a current to the second capacitor (i.e. for charging the second capacitor with a voltage corresponding to the current).

The eighth transistor T8 includes a gate electrode connected to the fifth control line CLn5, a first electrode connected to the fifth node N5, and a second electrode connected to the anode of the OLED.

The first capacitor C1 is connected between the first node N1 and the second node N2. The first capacitor C1 is charged with a voltage corresponding to a data signal that is applied for each sub-frame.

The second capacitor C2 is connected between the third node N3 and the fourth node N4. The second capacitor C2 is charged with a voltage corresponding to a programming current that is applied before one frame starts. The programming current is a current having a maximum gray level that can be expressed by the pixel PX.

The OLED may include a first electrode, a second electrode opposite to the first electrode, and an emission layer interposed between the first electrode and the second electrode. The first and second electrodes may be an anode and a cathode, respectively. The anode of the OLED is connected to the second electrode of the eighth transistor T8, and the cathode thereof receives the second power supply voltage ELVSS.

Figure 3:
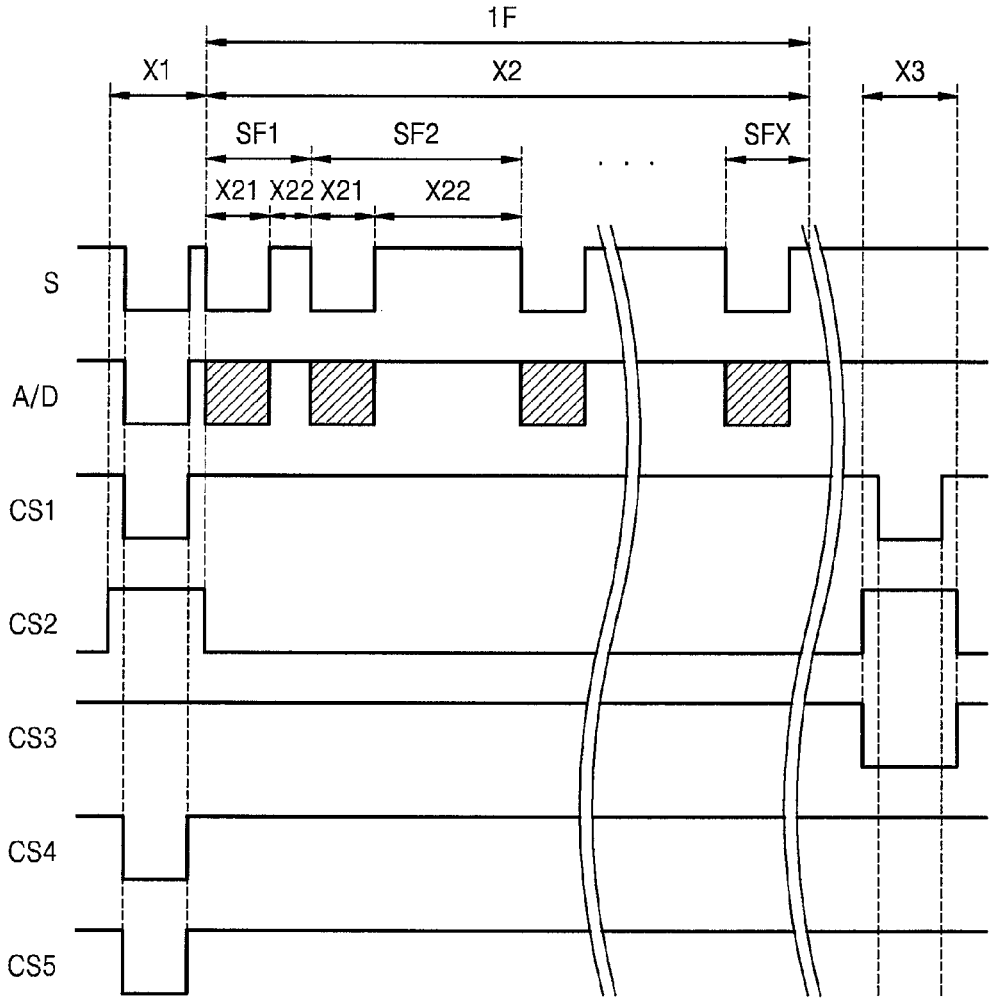
FIG. 3 is a timing diagram for illustrating a driving timing of a pixel, according to an embodiment of the present invention.

FIG. 3 is a timing diagram for illustrating a driving timing of a pixel, according to an embodiment of the present invention. FIGS. 4-7 are circuit diagrams for illustrating operations of the pixel according to the driving timing of FIG. 3. The pixel PX of FIG. 2 will now be illustrated as an example.

The pixel PX operates in a current programming mode for writing a programming current during a first period X1, operates in a data programming mode for writing a data signal, operates in a light-emitting mode for emitting light or emitting no light in correspondence with the data signal during a second period X2, and operates in a current sensing mode for sensing degradation of an OLED during a third period X3.

The first period X1 may be allocated as a time period (e.g., a preset or predetermined time period) before one frame starts or in an initial part of one frame. FIG. 3 illustrates an example in which the first period X1 is allocated before one frame starts.

The second period X2 is allocated within the one frame, and the pixel PX operates in the data programming mode and in the light-emitting mode during each of sub frames SF1-SFX that constitute the one frame. A time interval between the end of the first period X1 and the start of the second period X2 may be controlled.

The third period X3 may be allocated as a period of time (e.g., a preset or predetermined period of time) when the display apparatus 100 is powered on and/or off.

Figure 4:
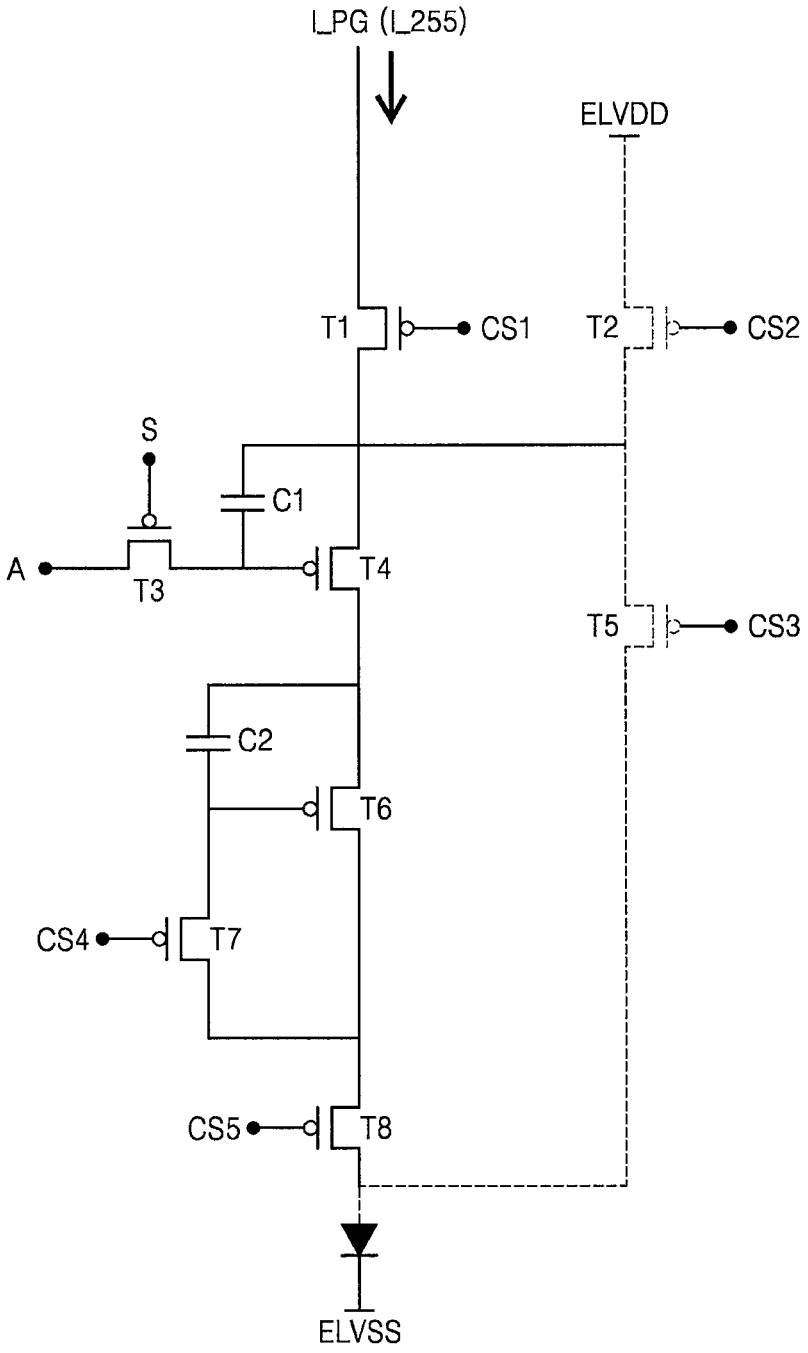
FIGS. 4-7 are circuit diagrams for illustrating operations of the pixel according to the driving timing of FIG. 3.

Referring to FIGS. 3 and 4, during the first period X1 in which the pixel PX operates in the current programming mode, the data driver 30 is connected to the data line DLm by the switch unit 80 and the sensing unit 70 is connected to the connection line ALm.

During the first period X1, a first control signal CS1, a scan signal S, a fourth control signal CS4, and a fifth control signal CS5 of a gate-on voltage (e.g., a low level voltage) are provided to the first control line CLn1, the scan line SLn, the fourth control line CLn4, and the fifth control line CLn5, respectively. Accordingly, the first transistor T1, the third transistor T3, the seventh transistor T7, and the eighth transistor T8 are turned on. An additional signal A having the first logic level provided to the data line DL when the third transistor T3 is turned on is applied to the gate electrode of the fourth transistor T4, and thus the fourth transistor T4 is turned on. The first logic level may correspond to the gate-on voltage. Thus, a voltage of the gate electrode of the sixth transistor T6 is determined based on a programming current I_PG that flows from the connection line ALm to the first transistor T1 and the fourth transistor T4. The sixth transistor T6 is diode-connected when the seventh transistor T7 is turned on. After the lapse of a period of time (e.g., a preset or predetermined period of time), the second capacitor C2 is charged with a charge corresponding to the programming current I_PG. In other words, a voltage corresponding to the programming current I_PG is stored in the second capacitor C2. The voltage stored in the second capacitor C2 does not depend on the threshold voltage of the sixth transistor T6. At this time, because the second transistor T2 is turned off, the OLED does not emit light. The programming current I_PG is a current corresponding to a maximum gray level that is expressed by the pixel PX. For example, as for the 8-bit image data, the programming current I_PG may be a current I_255 having a gray level of 255.

During the first period X1, the second transistor T2 and the fifth transistor T5 are in a turned off state according to a second control signal CS2 and a third control signal CS3 of a gate off voltage (e.g., a high level voltage).

The first period X1 may be set as a period of time that is required for a charging current of the second capacitor C2 to stop flowing because an output current in the second electrode of the fourth transistor T4 equals to that in the second electrode of the sixth transistor T6.

The second period X2 includes a (2-1)th period X21 during which the pixel PX operates in the data programming mode, and a (2-2)th period X22 during which the pixel PX operates in the light emitting mode. During one frame, the (2-1)th period X21 and the (2-2)th period X22 repeat as many times as the number of sub-frames that constitute one frame. The respective (2-2)th periods X22 of the sub-frames may have different lengths.

During the second period X2, the data driver 30 is connected to the data line DLm by the switch unit 80, and the sensing unit 70 is disconnected from the connection line ALm, and thus the connection line ALm is in a high impedance state High Z.

Figure 5:
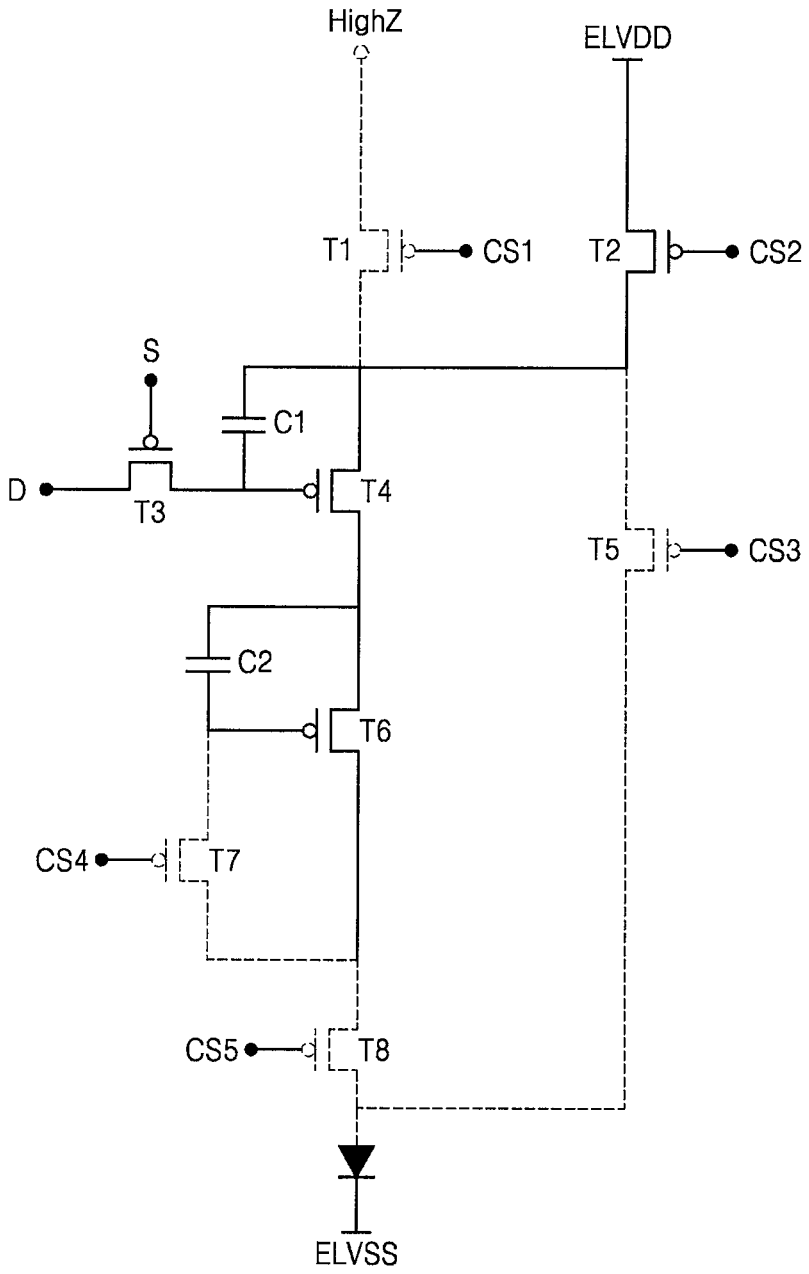

Referring to FIGS. 3 and 5, during the (2-1)th period X21 in which the pixel PX operates in the data programming mode, the scan signal S and the second control signal CS2 of the gate-on voltage (e.g., a low level voltage) are supplied to the scan line SLn and the second control line CLn2. Accordingly, the third transistor T3 and the second transistor T2 are turned on, and a data signal D is transmitted from the data line DLm to the gate electrode of the fourth transistor T4 by the third transistor T3. A voltage corresponding to the data signal D is stored in the first capacitor C1. The data signal D corresponds to the first logic level or the second logic level.

During the (2-1)th period X21, the first transistor T1, the fifth transistor T5, the seventh transistor T7, and the eighth transistor T8 are turned off according to the first control signal CS1, the third control signal CS3, the fourth control signal CS4, and the fifth control signal CS5 of the gate off voltage (e.g., a high level voltage).

Figure 6:
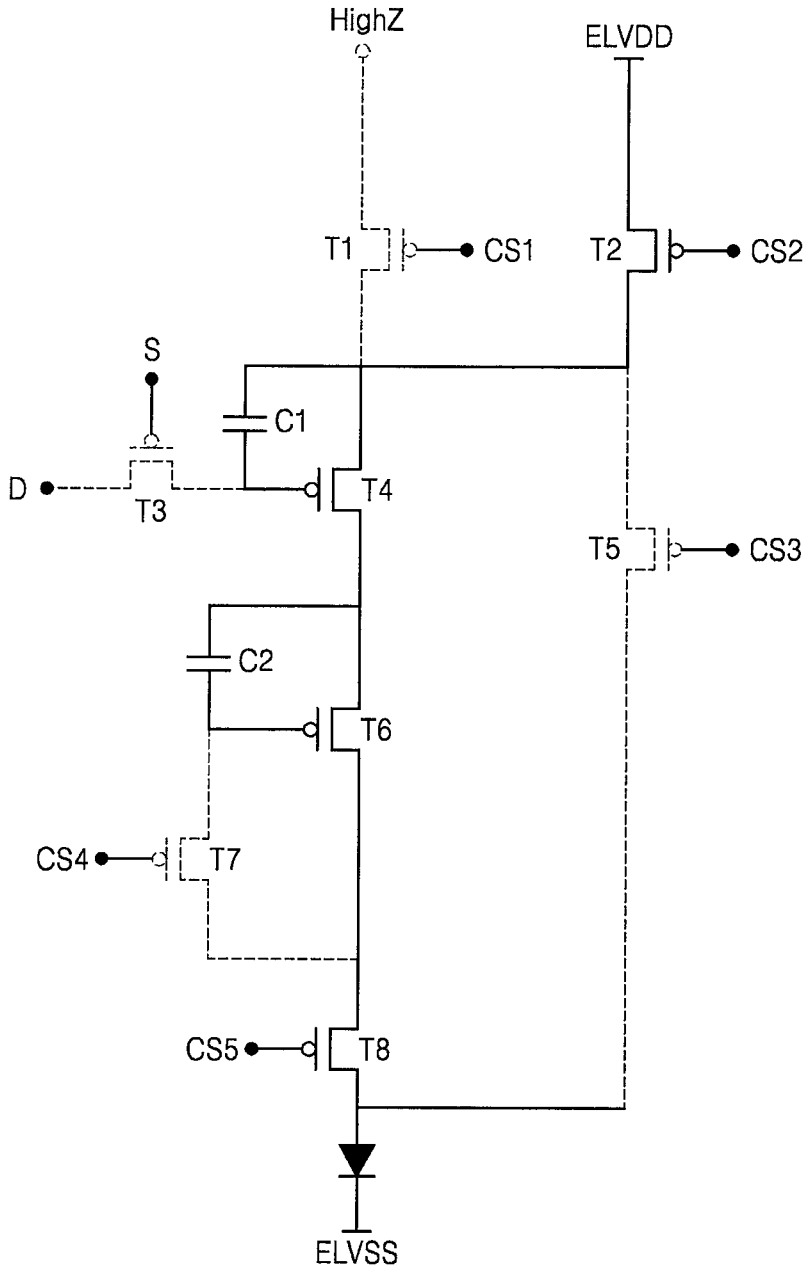

Referring to FIGS. 3 and 6, during the (2-2)th period X22 in which the pixel PX operates in the light emitting mode, the scan signal S of the gate off voltage is supplied to the scan line SLn and thus the third transistor T3 is turned off. The fifth control signal CS5 of the gate-on voltage is supplied to the fifth control line CLn5, and thus the eighth transistor T8 is turned on. The second transistor T2 keeps being turned on and supplies the first power supply voltage ELVDD, and the fourth transistor T4 is turned on or off according to the logic level of the data signal D, namely, the voltage stored in the first capacitor C1. When the fourth transistor T4 is turned on, a current corresponding to the voltage stored in the second capacitor C2 flows into the OLED, and the OLED emits light having a brightness corresponding to the current.

By using the voltage charged in the second capacitor C2 by the programming current I_PG, a voltage drop of a power line that provides the first power supply voltage ELVDD during the (2-2)th period X22 may be reduced.

During the (2-2)th period X22, the third transistor T3, the first transistor T1, the fifth transistor T5, and the seventh transistor T7 are turned off according to the scan signal S, the first control signal CS1, the third control signal CS3, and the fourth control signal CS4 of the gate off voltage (e.g., a high level voltage).

Figure 7:
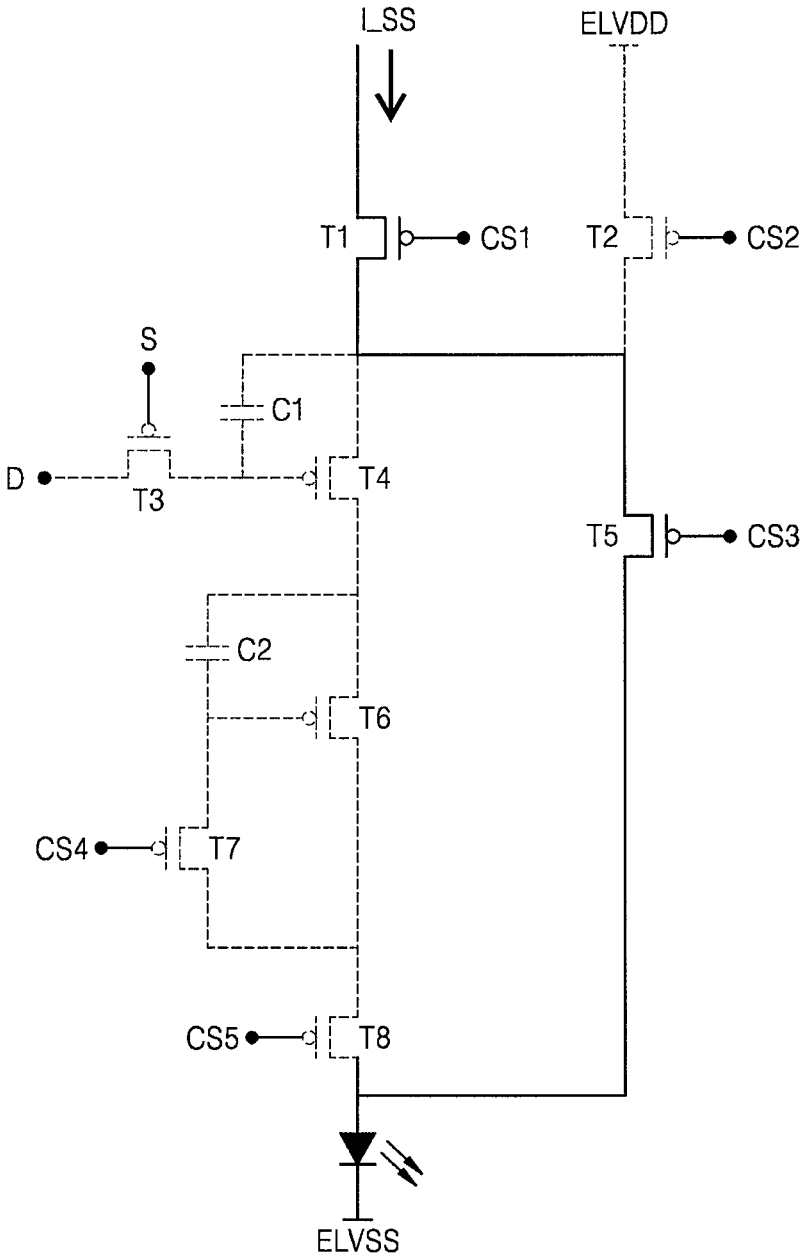

Referring to FIGS. 3 and 7, during the third period X3 in which the pixel PX operates in the current sensing mode, the data driver 30 is connected to the data line DLm by the switch unit 80 and the sensing unit 70 is connected to the connection line ALm.

The first control signal CS1 and the third control signal CS3 of the gate-on voltage are supplied to the first control line CLn1 and the third control line CLn3, and thus the first transistor T1 and the third transistor T3 are turned on. A sensing current I_SS supplied to from the connection line ALm is applied to the OLED via the first transistor T1 and the fifth transistor T5, and thus the OLED emits light. Because the magnitude of the sensing current I_SS varies according to the degree of degradation of the OLED, the sensing unit 70 may sense the degree of degradation of the OLED from the sensing current I_SS flowing into the OLED.

Figure 8:
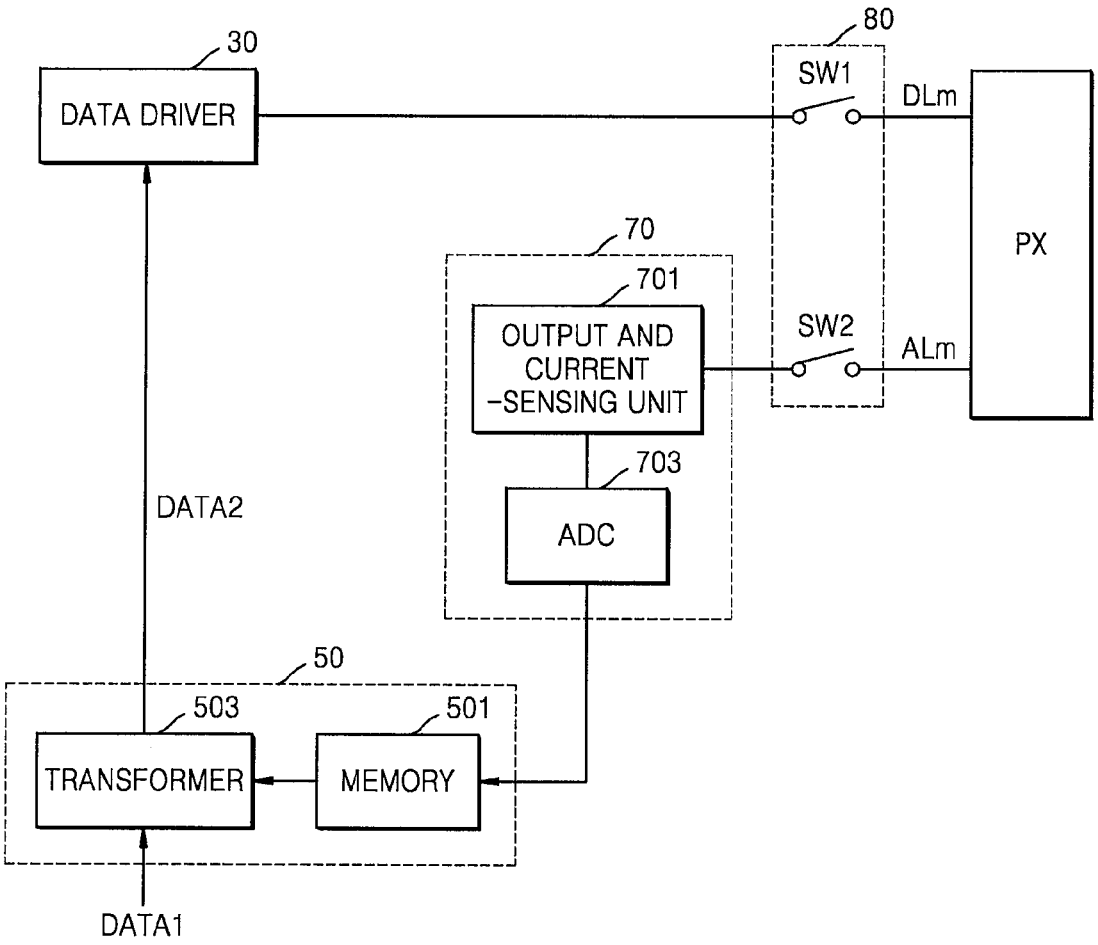
FIG. 8 illustrates a sensor and a controller included in the display apparatus of FIG. 1.

FIG. 8 illustrates the sensing unit 70 and the controller 50 of FIG. 1.

For convenience of illustration, FIG. 8 illustrates a pixel PX connected to the m-th data line DLm from among the data lines DL1-DLm and the m-th connection line ALm from among the connection lines AL1-ALm.

An output and current-sensing unit 701 and an analog-to-digital convertor (ADC) 703 are included in each channel (connection line) of the sensing unit 70.

The output and current-sensing unit 701 is a circuit that is connected to the connection line ALm via the switch unit 80. When the pixel PX operates in the current programming mode, the output and current-sensing unit 701 outputs the programming current to the pixel PX and the programming current is written to the pixel PX. When the pixel PX operates in the current sensing mode, the output and current-sensing unit 701 senses a current that flows into an OLED of the pixel PX. In the current sensing mode, the current sensed by the output and current-sensing unit 701 represents the degree of degradation of the OLED and is transmitted to the ADC 703.

The switch unit 80 includes a first switch SW1 and a second switch SW2. The first switch SW1 is located on the m-th data line DLm connected to the data driver 30. When the first switch SW1 is turned on, the corrected data DATA2 is transmitted as a data signal to the pixel PX via the m-th data line DLm. The first switch SW1 may not be included. The second switch SW2 is located on the m-th connection line ALm connected to the output and current-sensing unit 701. When the second switch SW2 is turned on, the programming current I_PG and the sensing current I_SS output by the output and current-sensing unit 701 are transmitted to the pixel PX via the m-th connection line ALm.

The output and current-sensing unit 701 may be implemented by using an integrating circuit that uses an operational amplifier (OA), however, embodiments of the present invention are not limited thereto. A first input terminal (+) of the OA is connected to a supply source of a reference voltage, and a second input terminal (−) thereof is connected to the m-th connection line ALm. An output terminal of the OA may be connected to the ADC 703 via the switch unit 80. A capacitor is included between the second input terminal (−) and the output terminal. When the reference voltage is applied to the first input terminal (+), a current I is applied via the m-th connection line ALm by a voltage difference between the second input terminal (−) and the output terminal. By adjusting the reference voltage, the magnitude of the current I flowing via the m-th connection line ALm may be adjusted. For example, by adjusting the reference voltage, the programming current I_PG or the sensing current I_SS may flow via the m-th connection line ALm. The sensing current I_SS flowing via the m-th connection line ALm may be calculated based on a difference between a voltage of the output terminal and the reference voltage, and may vary according to the degree of degradation of the OLED.

The ADC 703 converts a current (a sensing current) of the OLED sensed by the output and current-sensing unit 701 into a digital value. The single ADC 703 may be used for a plurality of channels of all channels, or all channels may share the single ADC 703.

The controller 50 may include a memory 501 and a transformer 503.

The memory 501 receives the digital value associated with the degradation of the OLED of each pixel from the ADC 703 and stores the received digital value. The memory 501 may include a look-up table (LUT) that stores a degradation compensation value corresponding to the digital value associated with the degradation.

The transformer 503 generates the corrected data DATA2 by correcting the input data DATA1 so that the degradation of the OLED is compensated for by using the digital value stored in the memory 501. The corrected data DATA2 is supplied to the data driver 30.

Figure 9:
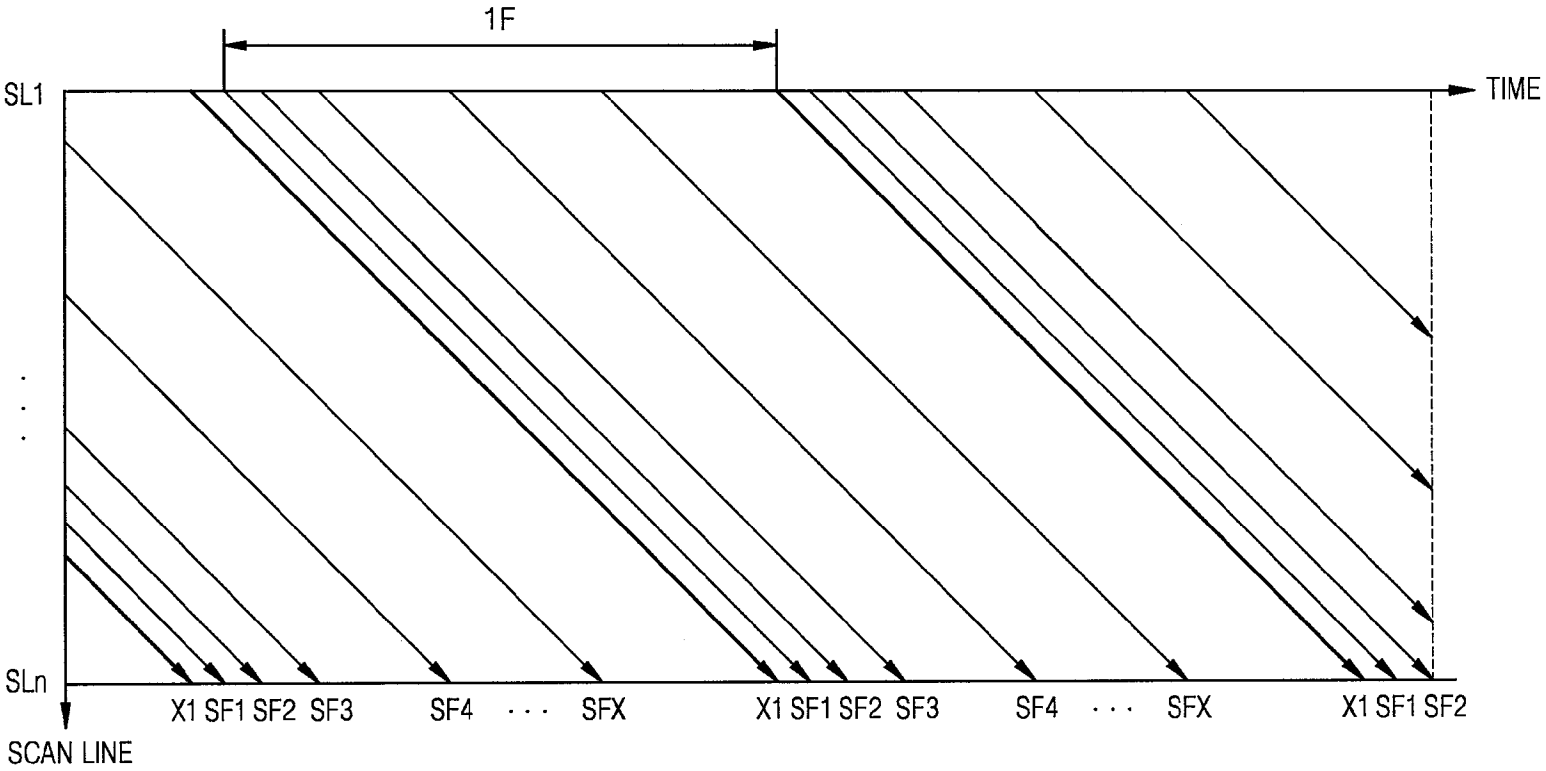
FIG. 9 is a timing diagram for illustrating a method of driving a display apparatus, according to an embodiment of the present invention.

FIG. 9 is a timing diagram for explaining a method of driving a display apparatus, according to an embodiment of the present invention.

Referring to FIG. 9, during each of sub frames SF1-SFX of one frame, a scan signal is applied to the scan lines SL1-SLn. Before one frame starts, namely, prior to the first sub-frame SF1, the scan signal is applied to the scan lines SL1-SLn during the first period X1 in which a pixel operates in the current programming mode. The width of the scan signal applied during the first period X1 may be equal to or different from that of the scan signal applied during each of the sub-frames SF1-SFX.

Because a digitally-driven pixel including current-writing transistors and current-sensing transistors according to embodiments of the present invention receives a programming current and a sensing current from a same or a substantially identical source, compensation data according to degradation of an OLED of the pixel may be calculated with increased accuracy. The digitally-driven pixel according to embodiments of the present invention may address a drop of a power supply voltage.

According to an embodiment of the present invention, the transistors of a pixel circuit are P-type transistors. In this case, a gate-on voltage that turns on the transistors is a low level voltage, and a gate off voltage that turns off the transistors is a high level voltage. Embodiments of the present invention are not limited thereto, and the transistors of the pixel circuit may be N-type transistors. In this case, a gate-on voltage that turns on the transistors is a high level voltage, and a gate off voltage that turns off the transistors is a low level voltage.

A transistor according to an embodiment of the present invention may be an amorphous silicon thin film transistor (amorphous-Si TFT), a low temperature poly-silicon (LTPS) TFT, or an oxide TFT. The oxide TFT may include oxide such as amorphous indium-gallium-zinc-oxide (IGZO), zinc-oxide (ZnO), or titanium oxide (TiO), as an active layer.

An organic light-emitting display apparatus according to an embodiment of the present invention may sense degradation of OLEDs and accordingly accurately correct image data. Moreover, the organic light-emitting display apparatus according to an embodiment of the present invention may be digitally driven without a drop of a power supply voltage.

It should be understood that the exemplary embodiments described therein should be considered in a descriptive sense only and not for purposes of limitation. Descriptions of features or aspects within each embodiment should typically be considered as available for other similar features or aspects in other embodiments.

While the present invention has been particularly shown and described with reference to exemplary embodiments thereof, it will be understood by those of ordinary skill in the art that various suitable changes in form and details may be made therein without departing from the spirit and scope of the present invention as defined by the following claims, and equivalents thereof.

What is claimed is:

1. An organic light-emitting display apparatus comprising at least one pixel, the at least one pixel comprising:

an organic light emitting diode (OLED);

a first transistor comprising a gate electrode, a first electrode connected to a connection line for providing a current, and a second electrode;

a second transistor comprising a gate electrode, a first electrode connected to a power line, and a second electrode connected to the second electrode of the first transistor;

a third transistor comprising a gate electrode, a first electrode connected to a data line, and a second electrode;

a fourth transistor comprising a gate electrode connected to the second electrode of the third transistor, a first electrode connected to the second electrode of the first transistor, and a second electrode;

a fifth transistor comprising a gate electrode, a first electrode connected to the second electrode of the fourth transistor, and a second electrode;

a sixth transistor comprising a gate electrode, a first electrode connected to the gate electrode of the fifth transistor, and a second electrode connected to the second electrode of the fifth transistor;

a seventh transistor comprising a gate electrode, a first electrode connected to the second electrode of the fifth transistor, and a second electrode connected to the OLED;

a first capacitor connected between the gate electrode and the first electrode of the fourth transistor; and a second capacitor connected between the gate electrode and the first electrode of the fifth transistor.

2. The organic light-emitting display apparatus of claim 1, wherein during a first period, fourth transistor is turned on by a gate-on voltage supplied via the data line when the third transistor is turned on, and a first current is supplied from the connection line when the first transistor is turned on, and the fifth transistor is diode-connected when the sixth transistor is turned on, and thus a voltage corresponding to the first current is stored in the second capacitor.

3. The organic light-emitting display apparatus of claim 2, wherein the first period is allocated before one frame starts or in an initial part of one frame.

4. The organic light-emitting display apparatus of claim 2, wherein the first current has a current value corresponding to a maximum gray level expressed by the pixel.

5. The organic light-emitting display apparatus of claim 1, wherein, during a first period of each of a plurality of sub-frames constituting one frame, the second transistor and the third transistor are turned on to store a voltage corresponding to a data signal applied from the data line in the first capacitor.

6. The organic light-emitting display apparatus of claim 5, wherein during a second period subsequent to the first period of each of the sub-frames, the second transistor is turned on, the third transistor is turned off, and the fourth transistor is turned on or off according to a voltage stored in the first capacitor, when the fourth transistor is turned off, the OLED does not emit light, and when the fourth transistor is turned on, the OLED emits light having a brightness corresponding to the voltage stored in the second capacitor.

7. The organic light-emitting display apparatus of claim 1, wherein the at least one pixel further comprises an eighth transistor comprising a gate electrode, a first electrode connected to the second electrode of the second transistor, and a second electrode connected to the OLED.

8. The organic light-emitting display apparatus of claim 7, wherein, during a third period, the second, third, fourth, fifth, sixth, and seventh transistors are turned off, the first transistor and the eighth transistor are turned on, and a second current supplied from the connection line is applied to the OLED.

9. The organic light-emitting display apparatus of claim 8, wherein the third period is allocated when the organic light-emitting display apparatus is powered on and/or off.

10. The organic light-emitting display apparatus of claim 7, further comprising:

a sensing unit configured to supply a first current to the connection line during a first period to write the first current to the pixel and to supply a second current to the connection line during a second period to sense a degradation of the OLED;

a controller configured to generate corrected data by compensating for the sensed degradation of the OLED; and a data driver configured to supply additional data to the data line during the first period and to supply corrected data to the data line during a third period.

11. The organic light-emitting display apparatus of claim 10, wherein the additional data comprises a signal having a first level to turn on the fourth transistor, and wherein the corrected data comprises a signal having a second level to turn off the fourth transistor or the first level.

12. A method of driving an organic light-emitting display apparatus, the method comprising:

supplying a first current to a pixel of organic light-emitting display apparatus to write the first current to the pixel;

supplying a data signal to the pixel to write the data signal to the pixel; and emitting light having a brightness corresponding to the first current or emitting no light, according to the data signal, wherein the emitting of light or the emitting of no light is performed in the pixel, wherein the pixel of the organic light-emitting display apparatus comprises:

an organic light emitting diode (OLED);

a first transistor comprising a gate electrode, a first electrode connected to a connection line for providing a current, and a second electrode;

a second transistor comprising a gate electrode, a first electrode connected to a power line, and a second electrode connected to the second electrode of the first transistor;

a third transistor comprising a gate electrode, a first electrode connected to a data line, and a second electrode;

a fourth transistor comprising a gate electrode connected to the second electrode of the third transistor, a first electrode connected to the second electrode of the first transistor, and a second electrode;

a fifth transistor comprising a gate electrode, a first electrode connected to the second electrode of the fourth transistor, and a second electrode;

a sixth transistor comprising a gate electrode, a first electrode connected to the gate electrode of the fifth transistor, and a second electrode connected to the second electrode of the fifth transistor;

a seventh transistor comprising a gate electrode, a first electrode connected to the second electrode of the fifth transistor, and a second electrode connected to the OLED;

a first capacitor connected between the gate electrode and the first electrode of the fourth transistor; and a second capacitor connected between the gate electrode and the first electrode of the fifth transistor.

13. The method of claim 12, further comprising:

supplying a gate-on voltage via the data line, when the third transistor is turned on, to turn on the fourth transistor, wherein the first current is supplied via the connection line when the first transistor is turned on, and the fifth transistor is diode-connected when the sixth transistor is turned on, and thus a voltage corresponding to the first current is stored in the second capacitor.

14. The method of claim 13, wherein the writing of the first current is performed before one frame starts or in an initial part of one frame.

15. The method of claim 12, wherein the first current has a current value corresponding to a maximum gray level expressed by the pixel.

16. The method of claim 12, wherein, in the writing of the data signal, during a first period of each of a plurality of sub-frames constituting one frame, the second transistor and the third transistor are turned on to store a voltage corresponding to a data signal applied from the data line in the first capacitor.

17. The method of claim 16, wherein, in the emitting of light or the emitting of no light in the pixel, during a second period subsequent to the first period of each of the sub-frames, the second transistor is turned on, the third transistor is turned off, and the fourth transistor is turned on or off according to a voltage stored in the first capacitor, and when the fourth transistor is turned off, the OLED emits no light, and, when the fourth transistor is turned on, the OLED emits light having a brightness corresponding to the voltage stored in the second capacitor.

18. The method of claim 12, wherein the pixel further comprises an eighth transistor comprising a gate electrode, a first electrode connected to the second electrode of the second transistor, and a second electrode connected to the OLED.

19. The method of claim 18, further comprising applying a second current supplied from the connection line to the OLED when the second to seventh transistors are turned off and the first transistor and the eighth transistor are turned on; and sensing degradation of the OLED based on the second current.

20. The method of claim 19, wherein the sensing of the degradation is performed when the organic light-emitting display apparatus is powered on and/or off.

* * * * *